United States Patent [19]

Lyons et al.

[11] 4,343,369

[45] Aug. 10, 1982

[54] APPARATUS FOR DRILLING STRAIGHT PORTION OF A DEVIATED HOLE

[75] Inventors: William C. Lyons; Scot L. Scurlock, both of Sante Fe, N. Mex.; Edward A. Zublin, Houston, Tex.

[73] Assignee: Drilling Development, Inc., Houston, Tex.

[21] Appl. No.: 188,728

[22] Filed: Sep. 19, 1980

[51] Int. Cl.[3] ..... E21B 7/08

[52] U.S. Cl. ..... 175/75; 175/61; 175/325; 464/19; 464/21

[58] Field of Search ..... 175/61, 73, 75, 74, 175/82, 83, 320, 321, 325, 256; 64/2 P

[56] References Cited

U.S. PATENT DOCUMENTS

| | | | |
|---|---|---|---|
| 2,382,933 | 8/1945 | Zublin | 175/61 |
| 2,585,207 | 2/1952 | Zublin | 175/75 |
| 2,694,549 | 11/1954 | James | 175/82 |
| 3,160,218 | 12/1964 | Crake | 175/75 X |
| 3,903,974 | 9/1975 | Cullen | 175/61 X |
| 4,067,404 | 1/1978 | Crase | 175/75 |

*Primary Examiner*—Ernest R. Purser
*Attorney, Agent, or Firm*—Vinson & Elkins

[57] ABSTRACT

A guide for drilling a straight section of a bore hole deflected from the vertical. The apparatus comprises either a normally straight or a curved-straight tubular member which has a plurality of generally circumferential cuts disposed along the length of the guide. The cuts allow the guide to be bent sufficiently to enter and traverse a short radius curve and then return to its normal configuration for guiding the drilling of the straight portion of the deflected bore hole. A clutch mechanism disposed in the drill guide permits engagement of the guide by the drill string for orientation of the guide.

12 Claims, 21 Drawing Figures

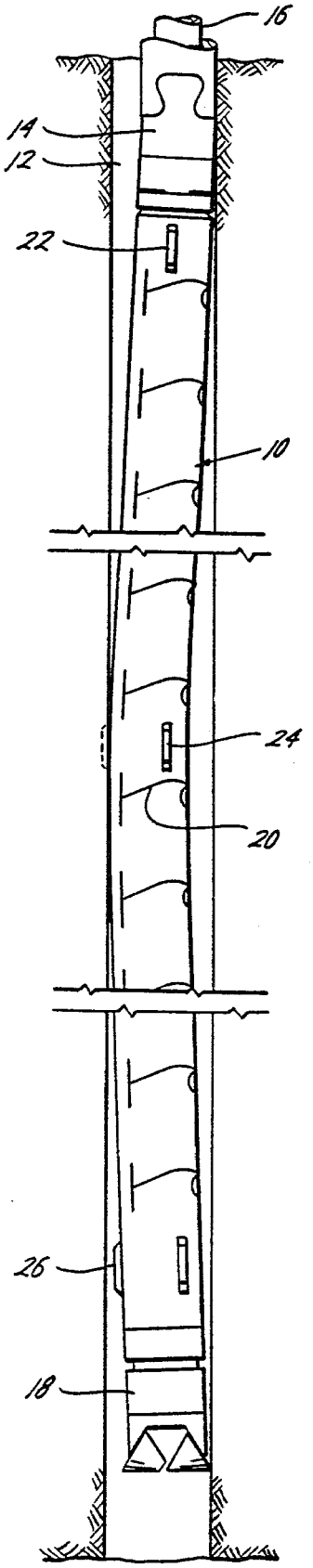
Fig. 1
Fig. 2A
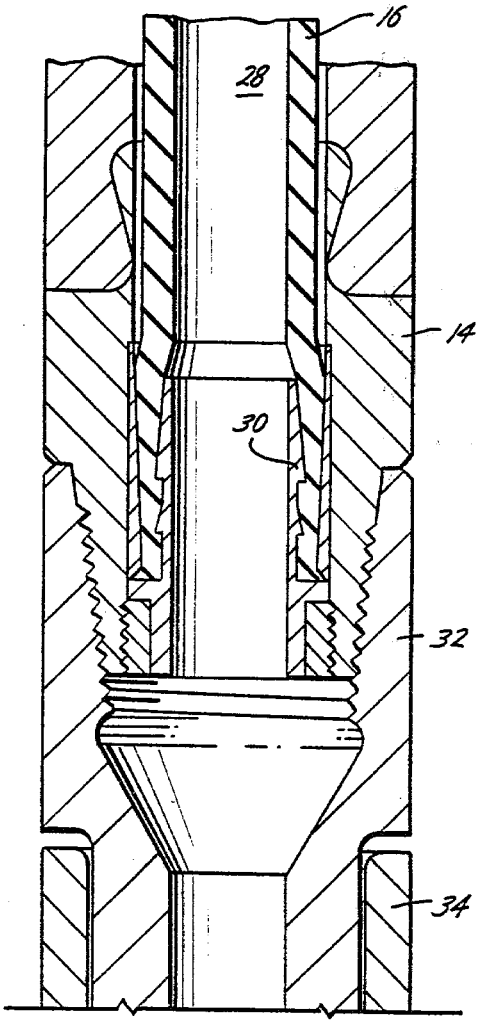

11a
22
10
20
24
26
11b
10'
Z'
Y'
90
80
91
91'
101
X
Z
84
100
88
Y
92
92'
94
82
99a
99b
99c
96
99d
99e
99f
106
98

5
5
58
22
22'
24'
24
24"
26'
26
26"
6
6
20
10
59

APPARATUS FOR DRILLING STRAIGHT PORTION OF A DEVIATED HOLE

BACKGROUND OF THE INVENTION

1. Field of the Invention

The invention relates to an apparatus for drilling a deviated bore hole and for drilling a straight section of bore hole which may be horizontal or at any angle from the terminus of a small radius curved bore hole.

2. Prior Art

There have been many efforts to develop apparatus for successfully drilling small radius deviated well bores. Prominent among those working in this field was J. A. Zublin, to whom many patents have issued. Typical of his efforts in this field is U.S. Pat. No. 2,631,820, which teaches the use of a curved drill guide to maintain a curved drill course in spite of radial forces working against the drill guide. Included in the use of the drill guide is a heavy duty flexible drill pipe as taught in U.S. Pat. No. 2,515,366.

Zublin again directed his attention to a curved drill guide in U.S. Pat. No. 2,664,270. In addition, this patent teaches the use of a rib, attached to the outside of the drill guide, to help stabilize the guide while rotating the flexible drill pipe of U.S. Pat. No. 2,515,366. The patentee used two or more ribs attached to the bottom end of the drill guide, as shown in the drawings, in order to limit the curvature of the well bore. Otherwise, there was a tendency to form a U-shaped well bore.

In U.S. Pat. No. 2,669,430, the patentee taught an apparatus for drilling devitated well bores utilizing a number of straight tubular drill guide sections. These so-called "straight" drill guide sections were stacked on the sectional drill collars, end to end, and designed so that the drill guide sections were rotatable relative to each other. Used in conjunction with a whipstock, they imparted flexibility to the drill string on making the curved drill path but became rigid for lateral drilling.

Another Zublin patent, U.S. Pat. No. 2,672,321, discloses a clutch mechanism useful with the curved drill guide of U.S. Pat. No. 2,515,366. The drill guide and clutch mechanism carried the drill string weight during drilling operations. In practice, the bearings of this clutch were not able to withstand the thrust loads required in normal drilling operations.

Other art in this field is represented in the following U.S. Pat. Nos.

2,336,338
2,344,277
2,402,003
2,515,365
2,634,097
2,680,358
2,684,581

OBJECTS OF THE INVENTION

It is a primary object to provide a drill guide for use in drilling laterally extended well bores.

A further object is to provide an improved orientation clutch assembly to be used in conjunction with said drill guide.

Another object is to provide an improved flexible drill guide which is bendable through a curved well bore and which will tend to guide a drill bit in an essentially straight drill path, which can be horizontal.

An additional object is to provide an improved flexible drill guide which is resistant to rotation in the well bore while the drill bit is rotating.

A further object of the invention is to provide an improved stabilizer system for more precise guiding of drilling direction using the drill guides of the invention.

These and other objects of the present invention will become apparent upon reading the following summary and detailed description of the preferred embodiments of the invention.

SUMMARY OF THE INVENTION

An apparatus for guiding the direction of drilling a well bore deflected from the vertical comprising: a flexible, resilient tubular member, said tubular member having disposed along at least a major portion of its length a plurality of shaped cuts, said cuts extending around the circumference of said tubular member but not severing said tubular member, and said tubular member not being normally curved throughout its entire length.

DESCRIPTION OF THE DRAWINGS

FIG. 1 is a schematic representation of one embodiment of the flexible drill guide of the invention, depicted extending downward in a well bore;

FIG. 2A-C is a plan sectional view of the clutch mechanism used with the flexible drill guide of the invention;

DETAILED DESCRIPTION OF THE PREFERRED EMBODIMENTS

Figure 2B:
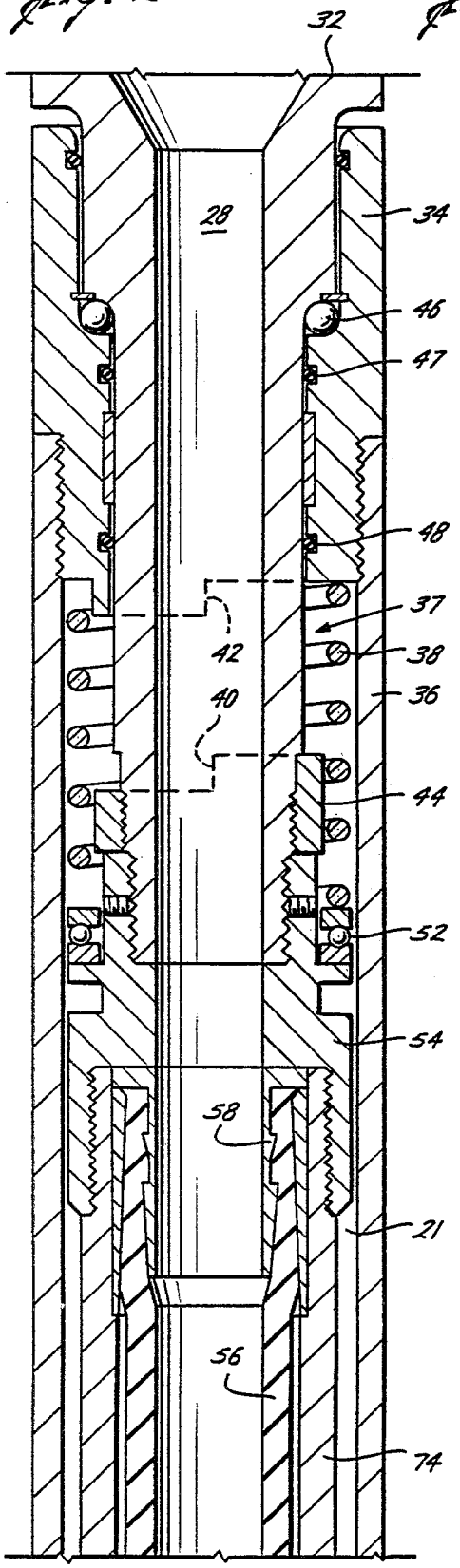

Referring to FIG. 1, there is illustrated schematically one embodiment of the flexible drill guide 10 positioned in a vertical well bore 12, being lowered to commence drilling a bore hole deviated from the perpendicular. The drill guide 10 surrounds and is carried by a sectional, flexible drill stem 14 which is referred to hereinafter as a drive pipe. The drill guide 10 illustrated in FIG. 1 is referred to as a "normally curved" drill guide.

The basic geometric configuration of the normally curved drill guide 10 has been known for a number of years. Typical of these is the curved drill guide 10 of FIG. 1 of U.S. Pat. No. 2,631,820. In utilizing the normally curved drill guide 10 of the present invention, the operator lowers the drill guide to virtually any point in a previously drilled well bore 12 and, selecting the proper azimuth, commence to drill a deviated hole using the drill bit 18 attached to the end 64 of an interiorly disposed drive pipe 14 and clutch member 37. The normally curved drill guide 10 carries stabilizer fins 22, 24 and 26 which act to prevent rotation of the drill guide 10 while the drill bit 18 is being operated. It has been found that the number and placement of the stabilizer fins is a critical factor in maintaining the proper drill path and azimuth. These will be discussed in more detail hereinafter.

Figures 3, 3A, 9, 11:
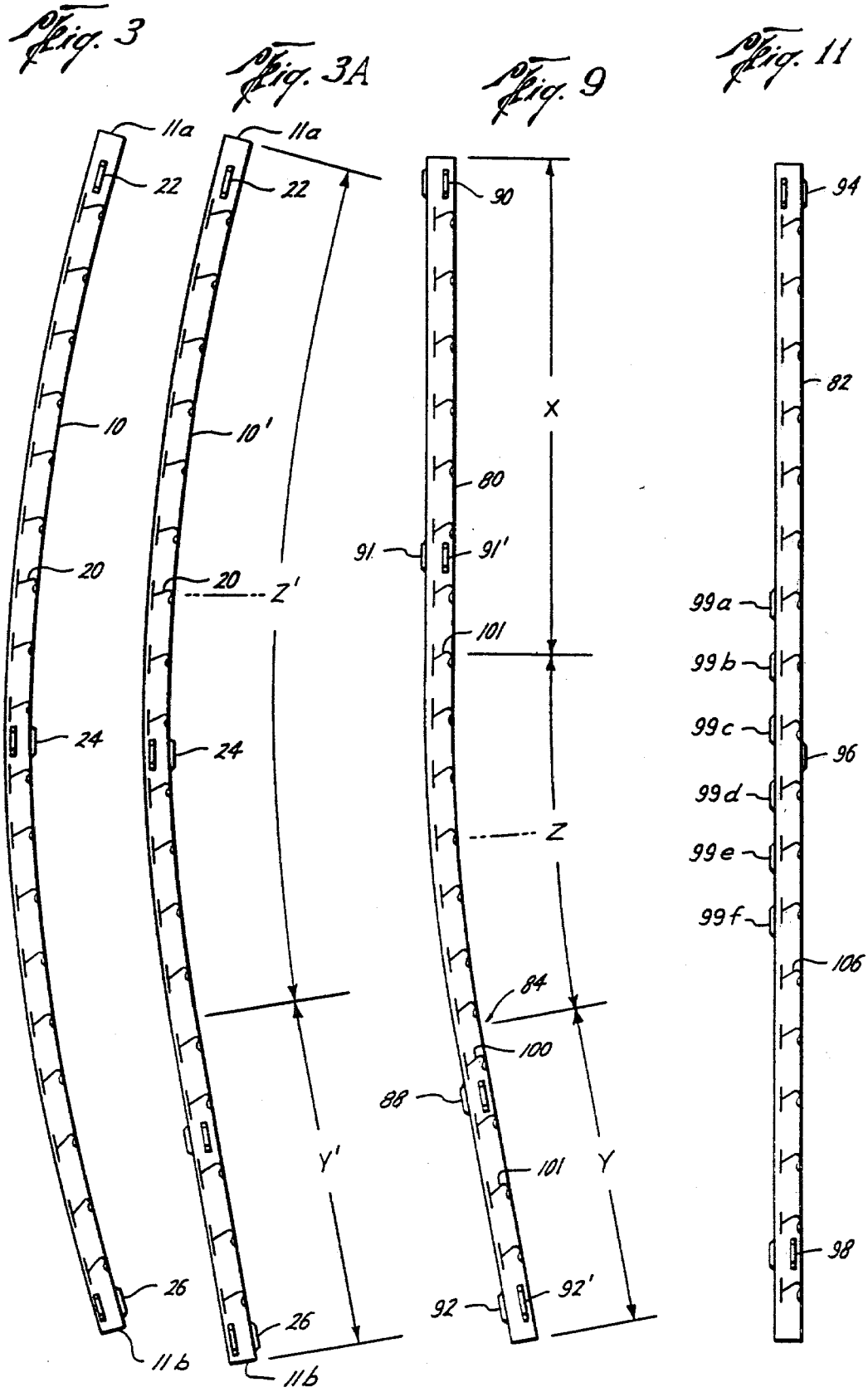
FIG. 3 is a schematic representation of a flexible drill guide having a noramlly curved configuration.
FIG. 3A is a schematic representation of one embodiment of a flexible drill guide having a normally partially curved configuration.
FIG. 9 is a schematic representation of one embodiment of a flexible drill guide embodiment having a noramlly partially curved configuration.
FIG. 11 is a schematic representation of the flexible drill guide embodiment having a normally straight configuration but which is bendable through a relatively short radius.
Figures 4A, 4B, 4C:
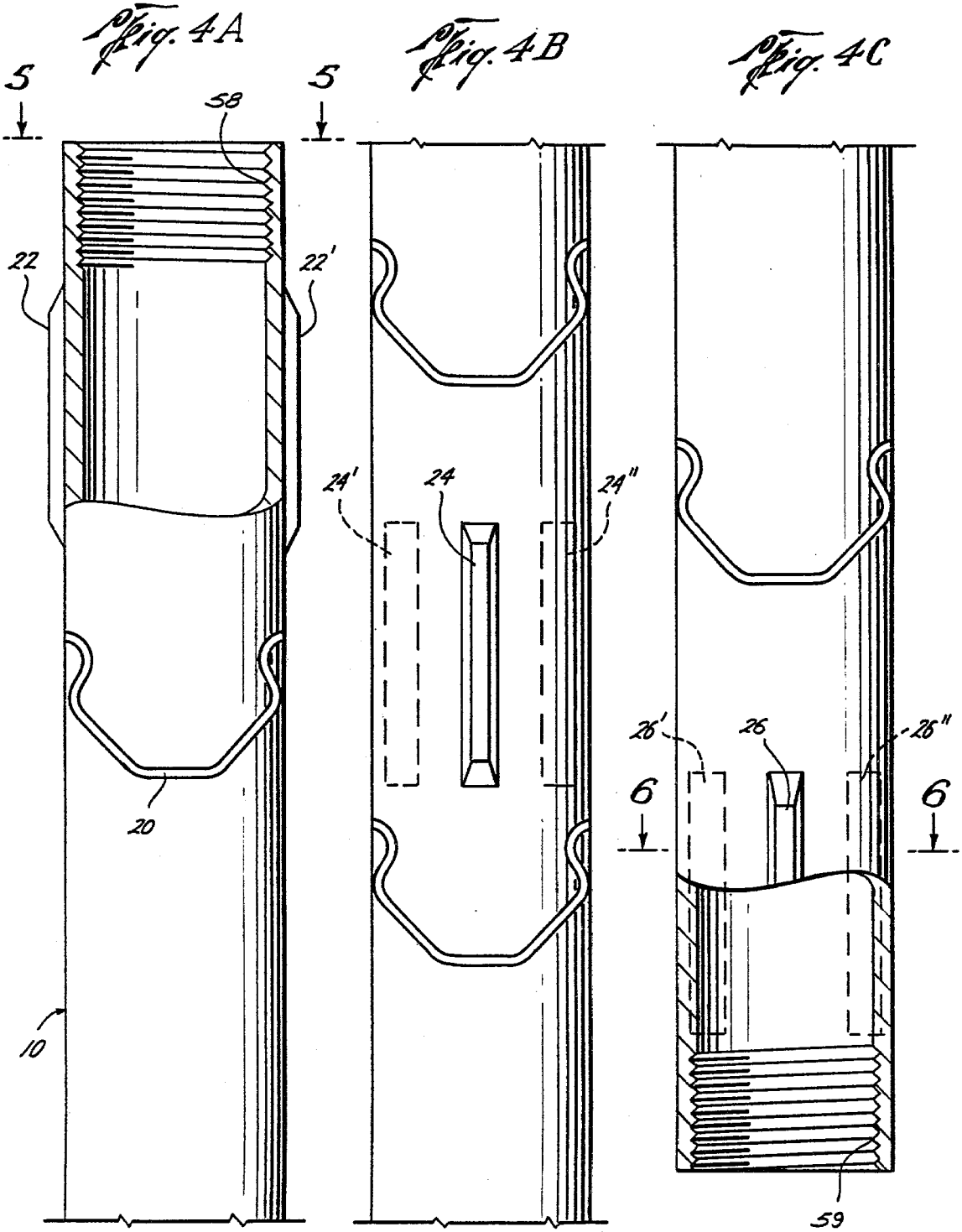
FIG. 4A-C is a plan, partially cut away view of the flexible drill guide of FIG. 3, illustrating the configuration of the stabilizer shoes attached thereto and the cuts made therein to impart flexibility.
Figure 5:
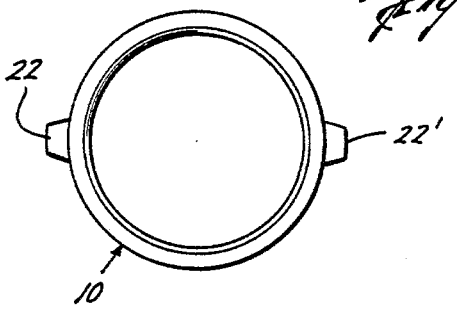
FIG. 5 is a cross-sectional view on the line 5—5 of FIG. 4A showing the positioning of the stabilizer fins attached to the upper end of the flexible drill guide.

It has now been discovered that for drilling the straight portion of a deviated hole, after the curve has been drilled with the normally curved drill guide 10 of FIG. 1 (shown schematically in FIG. 3), a flexible drill guide having at least a portion of its length normally straight, as illustrated in FIGS. 3A, 9 and 11, should be used. It is preferred that at least a portion of its straight section should be on the bit end of the flexible drill guide.

Thus, in FIG. 3A there is illustrated an embodiment of the flexible drill guide 10' of the invention wherein the straight portion Y' thereof comprises about one-third of the length of the drill guide 10'. However, this is just an approximation and is not critical. What is important is that at least some part of the bit end **11*b* of the drill guide be essentially straight, compared to the noramlly curved portion Z' of the drill guide 10'**.

Another embodiment of the invention is illustrated in FIG. 9, wherein a greater portion of the flexible drill guide 80 is essentially straight. These are the lengths X and Y, while the portion Z is curved. In this embodiment, approximately two-thirds of the drill guide 80 is straight. Again, this proportion is a rough approximation, and is not critical.

The normally curved-straight drill guides 10' and 80, as illustrated in FIGS. 3A and 9, should be used for entering a deviated hole which has been kicked off from the side of an open well bore. The normally straight drill guide 82 shown in FIG. 11 is a variation of the drill guide of FIG. 3A and 9, and would be used when the deviated hole is kicked off from the bottom of a vertical hole or when some other device is used to insert the normally straight drill guide into a side track.

The normally straight 82 and curved-straight 10' and 80 drill guides of FIGS. 11, 3A and 9, respectively, are preferably each constructed from single pieces of annealed steel tubing. Each drill guide receives a series of special cuts 100 (and 106). The cuts are illustrated in FIGS. 7 and 8, in template form showing relative dimensions of the radial and longitudinal portions of the cuts.

The cuts 100 are spaced at essentially equal distances apart along the length of the drill guides 80 and 82. The cuts 100 are made radially across the guide and intersect a longitudinal cut 102 having ends 104 and 104'. The radial cut 100 is made at an angle to the plane of the drill guide 80. This permits the drill pipe 80 to be bent somewhat and the cut surfaces are able to act as bearing surfaces.

Figure 7:
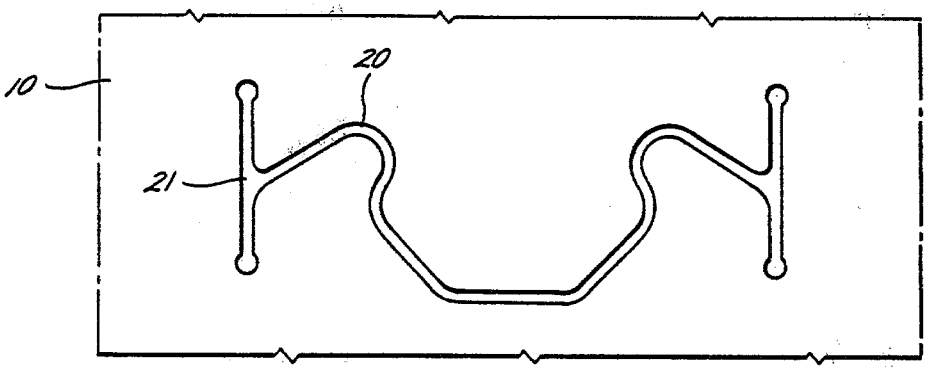
FIG. 7 is a laid out section of the flexible drill guide of FIG. 3, showing the cut made therein.
Figure 8:
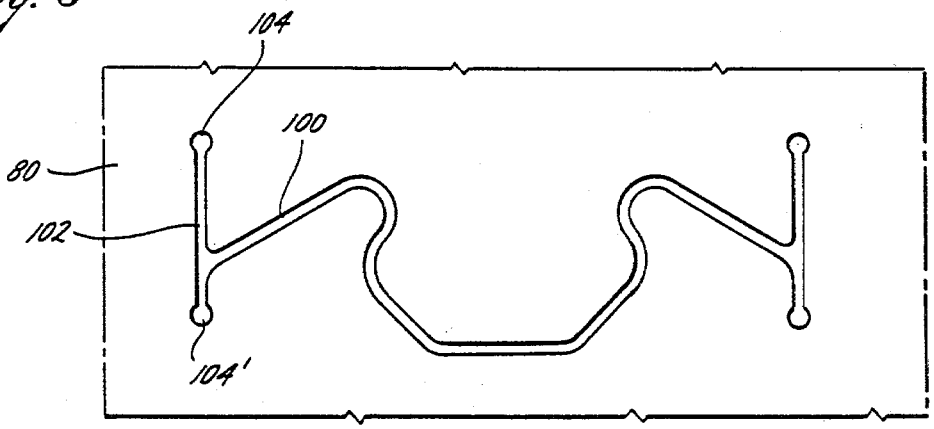
FIG. 8 is a laid out section of the flexible drill guide of FIG. 9, showing the cut made therein.
Figure 10A:
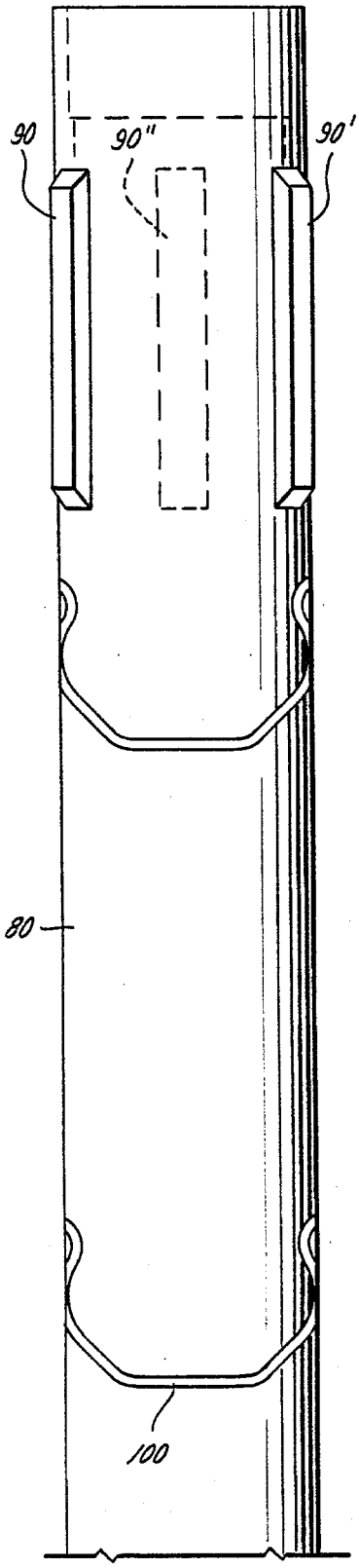
FIG. 10A-C is a plan view of the flexible drill guide of FIG. 9, showing the fin arrangement therein.
Figure 10B:
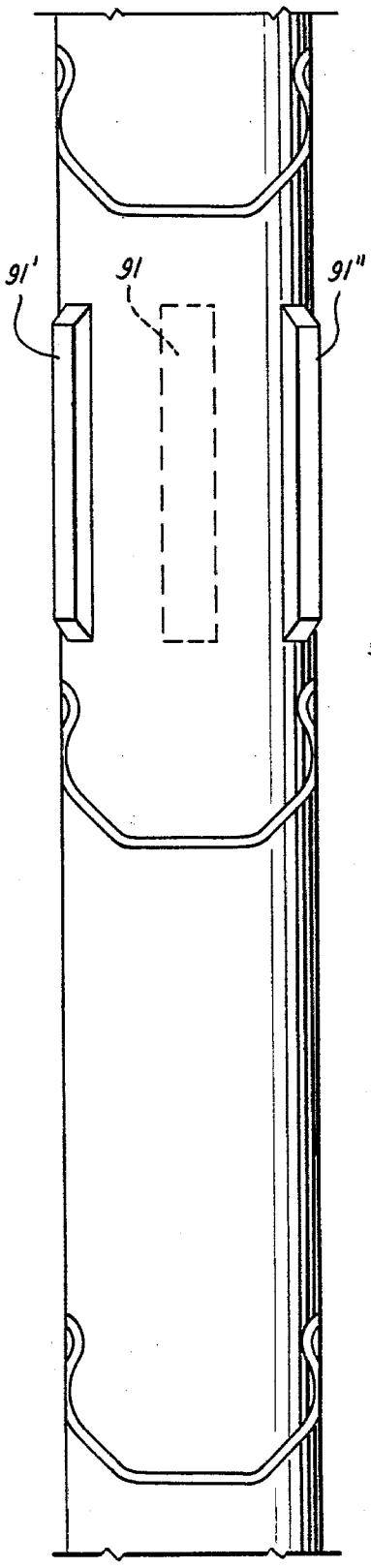
Figure 10C:
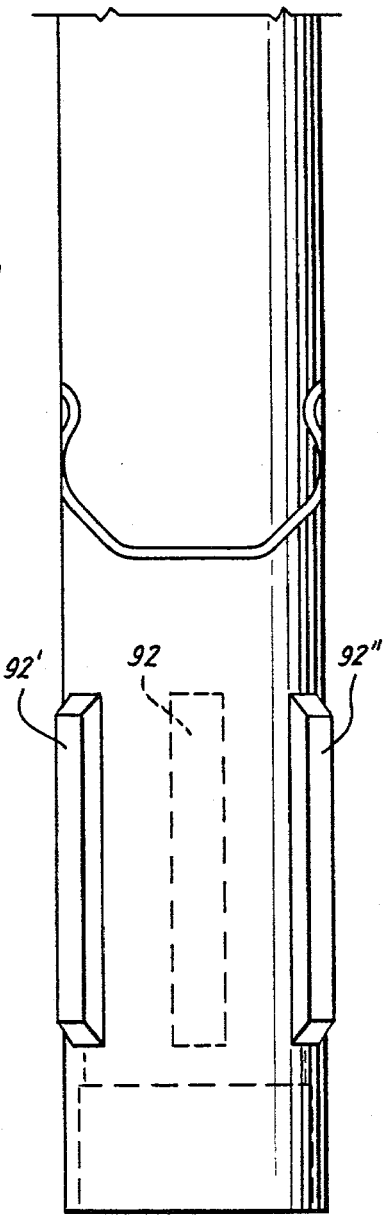

It has been found that either the short cut 20 of FIG. 7, or the longer cut 100 of FIG. 8 may be used with the straight drill guide 82 and the curved-straight drill guide 80. Alternatively, there may be used a combination of short and long cuts, as illustrated in FIG. 9, with the longer cuts 100 used in the curved portion of the guide 80.

The cuts 100, of the normally straight 82 and the curved-straight 80 drill guides are placed at a predetermined distance from one another to provide the needed flexibility for the guides 80 and 82 to traverse both the horizontal and curved sections of the deviated hole.

As previously mentioned, the stabilizer fins are used to maintain the desired angle of declination and azimuth while drilling the straight portion of the deviated hole using the normally straight drill guide 82 and the curved-straight drill guide 80. Referring to FIG. 9, the drill guide 80 has an upper set of fins 90 and a lower set of fins 92 placed thereon. Also, there are preferably two sets of fins 88 and 91 placed at intermediate locations along the length of the drill guide 80. Preferably, the upper set of intermediate fins 91 should be placed just above the curved portion Z of the drill guide 80. It is preferred that the lower intermediate fins 88 be placed just below the curved portion Z of the drill guide 80. However, the positions of these intermediate fins 88 and 91 are not critical and can be varied for particular drilling requirements.

For the purpose of position for the upper 90 and lower 92 fins on the curved-straight drill guide 80, the direction of curvature side shall be referred to as the "face" side of the drill guide 80. Referring to FIGS. 9 and 10A-C, it will be seen that the upper fins 90 are preferably positioned to provide at least one fin 90" on the side opposite the face side of the drill guide 80. The lower fins 92 are preferably placed on the drill guide 80 to provide at least one fin 92 on the side opposite the face side of the drill guide 80.

Figure 6:
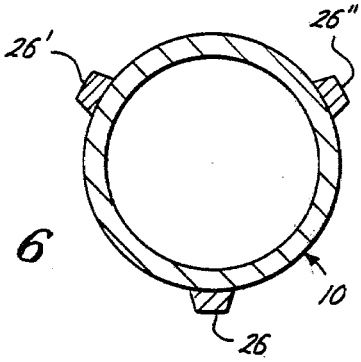
FIG. 6 is a cross-sectional view on the line 6—6 of FIG. 4C showing the positioning of the stabilizer fins attached to the lower end of the flexible drill guide.

All four sets of fins 90, 90', 90" and 91, 91', 91" and 92, 92', 92" and 88 (rest not shown in FIG. 10A-C) are preferably placed around the circumference of the drill guide 80 to provide a configuration essentially as shown in FIG. 6.

Figure 12A:
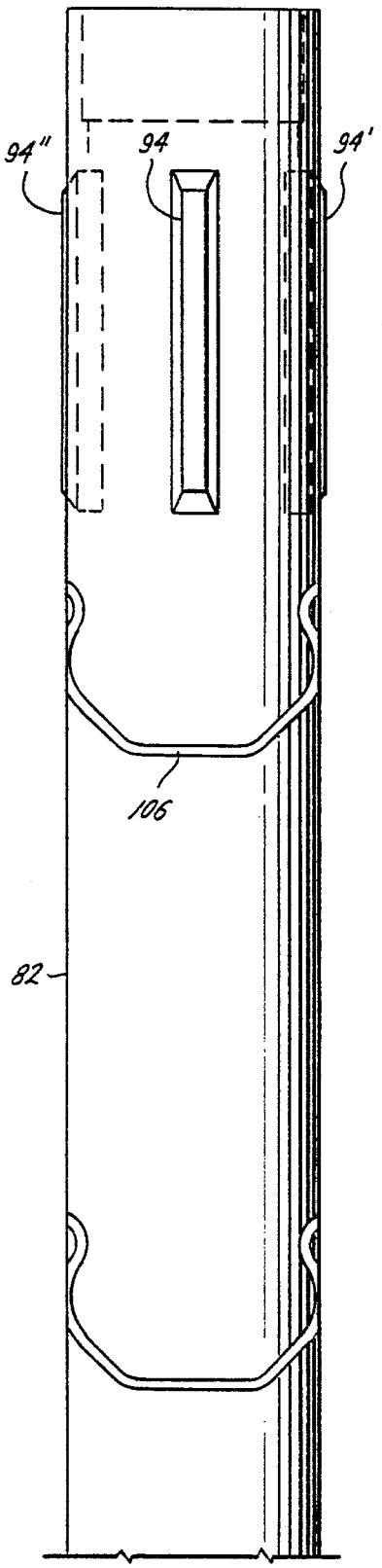
FIG. 12A-C is a plan view of the flexible drill guide of FIG. 11, showing the fin arrangement therein.
Figure 12B:
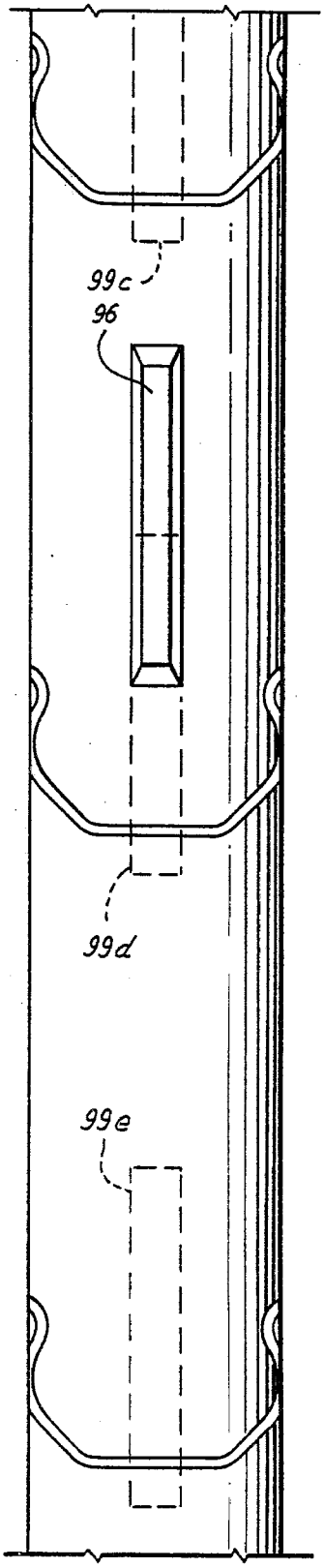
Figure 12C:
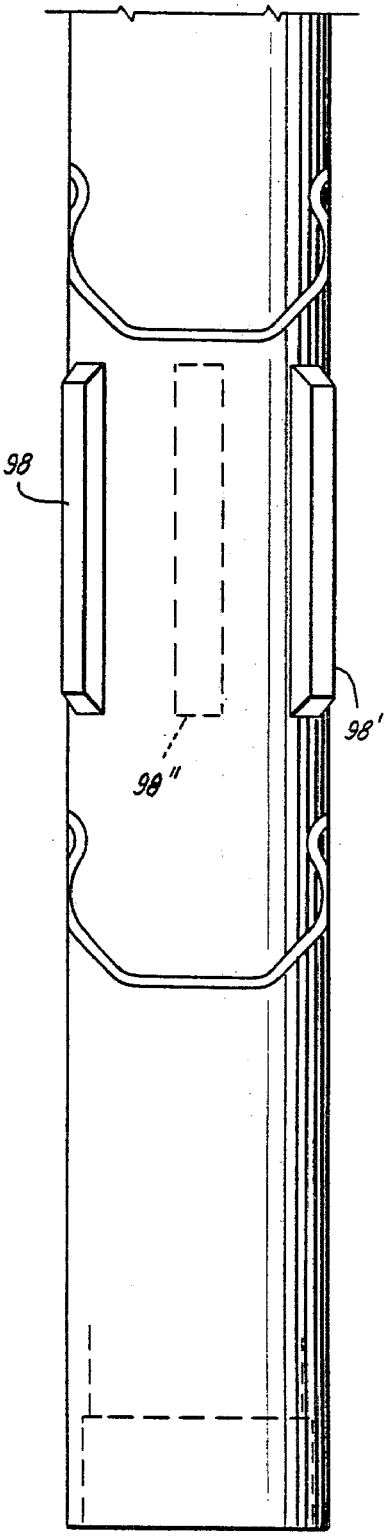

With regard to the fins of the normally straight drill guide, shown in FIG. 11, reference is made to FIG. 12A-C. For purpose of explanation, the cut side of the drill guide 82 shall be referred to as the face side. It has been unexpectedly found that the best stabilization results are achieved by placing at least one fin 94 on the face side of the upper end of the normally straight drill guide 82. A plurality of fins 94' and 94" should be spaced about the circumference of the upper end of the drill guide 82, essentially as shown in FIG. 6.

At the lower, drill bit end of the normally straight drill guide 82, at least one fin 98" should preferably be placed on the side opposite the face side of the drill guide 82. A plurality of additional fins 98 and 98' are spaced circumferentially around the lower end of the drill guide, essentially as shown in FIG. 6.

While the normally curved drill guide 10 configuration is known in the art, it has been unexpectedly found that the addition thereto of stabilizer fins 22 and 26, as shown in FIGS. 3, 5, 6 and 4A-C, provide stabilization to the normally curved drill guide 10 previously unattainable. The upper end fins 22 and 22' are placed around the circumference of the upper end of the drill guide in the manner shown in FIG. 5, preferably placed opposite each other.

On the lower end of the normally curved drill guide 10 are a similar series of circumferentially placed finds 26, 26' and 26". However, one fin 26 is preferably placed on the cut side of the drill guide 10. The remaining fins 26' and 26" are spaced equidistantly apart around the circmference of the drill guides' 10 lower end.

At essentially the longitudinal mid point of the drill guide 10 there are placed a third series of fins 24, 24' and 24" spaced equidistantly around the circumference of the drill guide 10. As with the lower fins 26, 26' and 26", one fin 24 is preferably placed on the cut side of the drill guide 10.

As previously mentioned, use of the normally straight 82, curved-straight 80 or curved-straight 10' drill guide permits drilling of an essentialy straight deviated hole after traversing the kickoff portion of the well. The drilling is accomplished by rotation of the drill bit 18 attached to the clutch mechanism 37, which in turn is attached to a plurality of connected drive pipe 14. Drilling fluid is conducted to the drill bit 18 through the normal drill pipe (not shown) connected to the upper terminus of the drive pipe 14.

Since the drive pipe 14 is segmented, suitable pressure resistant tubing 16 traverses the interior of the drive pipe 14 and terminates at the end of the drive pipe 14 connected to the upper end sub 32 of the clutch mechanism 27 in a manner to be more fully described hereinafter. It is preferred to utilize a reinforced elastomer in constructing the drilling fluid tubing 16. The elastomer should preferably be capable of withstanding the temperature encountered in drilling to extended depths and be resistant to drilling chemicals and hydrocarbons. Such elastomers are typically, neoprene, ethylene-propylene-diene type terpolymers, ethylene-propylene copolymers, SBR alone or blended with other elastomers, natural rubber and the like, either alone or suitably blended with other materials.

The lowermost end of the elastomer tubing 16 is securedly connected to the lower terminus of the drive pipe 14 by suitable clamping means 30, as shown in FIG. 2A. The drive pipe 14 is connectable to the upper end sub 32 of the clutch mechanism 37.

The clutch mechanism 37 is used in reorienting the drill guide 36 in order to change direction of drilling. As mentioned previously, the drive pipe 14 is connected through the clutch 37 to the drill bit 66. The drill guide 36 does not rotate with the drive pipe 4 and drill bit 66.

With the drill guide 36 being frictionally engaged with the bore hole and the clutch mechanism 37 being freely rotatable therein, there is provided means for securing the clutch 37 to the drill guide 36 to permit rotation of the drill guide to a new direction.

Figure 2C:
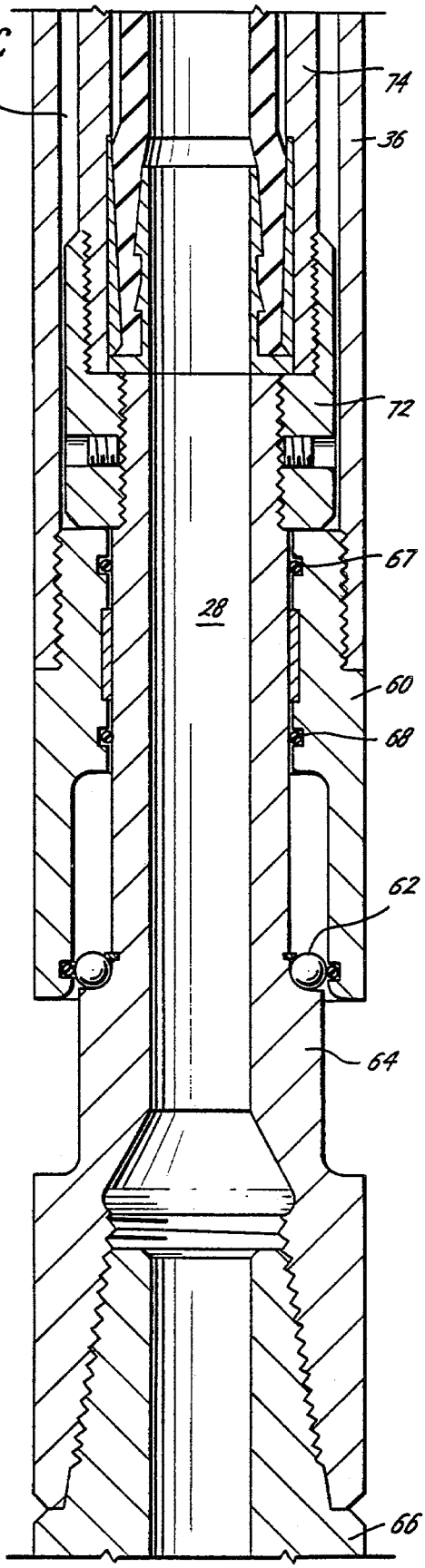

Referring to FIG. 2A-C, there is shown the drill guide 36 of the invention, having connected thereto an upper clutch 34 and a bottom cap 60. Disposed within the bore 21 of the drill guide 36 is the clutch mechanism 37, which includes a top sub 32, connectable to the drive pipe 14, means 56 for conducting drilling fluid through a clutch mechanism 37, and a bottom sub 64, connectable to a drill bit 66.

There is additionally provided a lower clutch dog 44 having a face 40 engageable with an opposing face 42 on the upper clutch 34. Resilient urging means 38 are positioned between the lower clutch dog 44 and the upper clutch 34 to prevent engagement of the opposing faces 40 and 42 during normal drilling operations. As shown in FIG. 2B, the resilient urging means illustrated is a spring member 38.

The spring 38 would be compressed during the period when the drill string would be pulled up, and friction would be restricting upward movement of the drill guide 36.

There is normally provided an inner drive pipe 74 connected within the drill guide 36. The inner drive pipe 74 is segmented in the same manner as the drive pipe 14 to allow bending thereof to follow the contour of the drill guide 36. In order to conduct drilling fluid through the bore 28 of the clutch mechanism 37, suitable conduit 56 is connected within the inner drive pipe 74, using suitable clamps 58 or other fastening means.

For assembly purposes, there is shown in FIG. 2B a top sub adapter 54 connecting the inner drive pipe 74 to the top sub 32. In like manner, a bottom sub adapter 72 connects the lower end of the inner drive pipe 74 to the bottom sub 64. It should be recognized that other suitable means can be used to connect the inner drive pipe 74 to the top sub 32 and the bottom sub 64.

It is preferred that there be provided a fluid sealing means 47 and 68 between the drill guide 36 and the clutch mechanism 37. As illustrated in FIGS. 2B and 2C, seals 47 and 48 are positioned on the bore surface of the top clutch 34 to seal against the outer surface of the top sub 32. In practice, the seals 47 and 48 can be any suitable configuration and can be placed on either the top clutch 34 of the top sub 32 of the clutch mechanism 37.

Similar seals 67 and 68 are preferably provided to seal between the bore surface of the bottom cap 60 and the other surface of the bottom sub.

When the drill stem is placed under a load as a consequence of placing weight on the drill bit 66, there is some compression but essentially no drilling weight placed on the inner drive pipe 74. However, compression of the inner drive pipe 74 will normally cause some shortening of the clutch mechanism 37. The drilling weight is carried by the drill guide 36. In order to prevent binding and friction between the clutch mechanism 37 and the drill guide 36, there is provided means 46 and 62 for reducing friction. These means are illustrated as bearings 46 and 62.

Preferably, there are provided an upper set of bearings 46 positioned to ride between the top sub 32 and the top clutch 34 of the drill guide 36. A second, lower set of bearings 62 are positioned to ride between the bottom sub 64 of the clutch mechanism 37 and the bottom cap 60 of the drill guide 36.

What is claimed is:

1. A flexible, resilient drill guide, connectable at its upper end to a rotary drill string and at its lower end to a rotary drill bit, for guiding the direction of drilling a well bore deflected from the vertical, said drill guide comprising:

an inner flexible segmented tubular drive member for transmitting rotational forces and drilling fluid between said drill string and said drill bit; and an outer flexible, resilient, tubular member for exerting directional drilling forces on said drill bit, said outer tubular member having disposed along at least a major portion of its length a plurality of non-connected shaped cuts extending therethrough and around a portion of the circmference thereof, but not severing said outer tubular member, and, said outer tubular member in an unstressed condition being normally curved through a portion of its length and normally straight through a portion of its length.

2. The drill guide according to claim 1 wherein the lower portion of said outer tubular member is normally straight.

3. The apparatus according to claim 1 whherein said shaped cuts comprise first and second circumferentially spaced-apart portions each generally parallel to the longitudinal axis of said outer tubular member, said first and second portions being interconnected by a sinuous third portion of substantially greater length than either of said first and second portions.

4. The apparatus of claim 3, wherein a majority of said second plurality of stabilizer fins are secured to the side of said tubular member opposite said cuts.

5. The apparatus of claim 3, wherein said tubular member is essentially straight, while in the unstressed state, for about at least two-thirds of its length with the remaining length thereof being normally curved.

6. The apparatus of claim 1, wherein said tubular member is essentially straight, while in an unstressed state, for about at least one-half of its total length with the remaining length thereof being normally curved.

7. The apparatus of claim 1, wherein said tubular member is essentially straight, while in an unstressed state, for about at least about two-thirds of its total length with the remaining length thereof being normally curved.

8. The apparatus of claim 1, wherein said tubular member is essentially straight, while in an unstressed state, for about one-third of its total length with the remaining length thereof being normally curved.

9. The apparatus of claims 6, 7 or 8, wherein the cuts made in said curved portion of said tubular member are of greater length than the cuts made in the straight portion of the tubular member.

10. The apparatus of claim 9, including a plurality of stabilizer fins being secured to each end of said tubular member.

11. An apparatus for guiding the direction of drilling a well bore deflected from the vertical comprising:

a flexible, resilient tubular member which is normally straight in an unstressed state for a portion of its length and is normally curved in an unstressed state for a portion of its length, said tubular member having disposed along at least a major portion of its length a plurality of non-connected, shaped cuts, said plurality of non-connected shaped cuts each comprising first and second circumferentially spaced-apart portions generally parallel to the longitudinal axis of said outer tubular member, said first and second portions being interconnected by a sinuous third portion of substantially greater length than either of said first and second portions, a flexible drive member rotatable within said tubular member and connectable to a drill string, said drive member being the torque bearing member, said flexible drive member being longitudinally movable within said tubular member, dog means carried on said tubular member and on said flexible drive member, engageable upon upward movement of said flexible drive member in relation to said tubular member, and which, when engaged, permits the tubular member to be moved for angular orientation.

12. A flexible, resilient drill guide, connectable at its upper end to a rotary drill string and at its lower end to a rotary drill bit, for guiding the direction of drilling a well bore deflected from the vertical, said drill guide comprising:

an inner flexible segmented tubular drive member for transmitting rotational forces and drilling fluid between said rotary drill string and said rotary bit; and an outer flexible, resilient, tubular member for exerting direction drilling forces on said drill bit, said outer tubular member in an unstressed state being straight for at least approximately one-third of its length and having disposed along at least a major portion of its length a plurality of nonconnected shaped cuts extending therethrough and around a major portion of the circumference thereof, but not severing said outer tubular member;

a first plurality of stabilizer fins positioned on the outer surface of said outer tubular member adjacent one end thereof for retarding rotation of said tubular member while guiding the direction of drilling of said drill bit; and, a second plurality of stabilizer fins positioned on the outer surface of said outer tubular member intermediate the ends thereof.

* * * * *